US008061627B2

(12) United States Patent
Norman et al.

(10) Patent No.: US 8,061,627 B2
(45) Date of Patent: Nov. 22, 2011

(54) FLEXIBLE TRACK SYSTEM

(75) Inventors: Casey W. Norman, Andoversford (GB); David Gamlin, Bath (GB)

(73) Assignee: Genie Toys plc (GB)

( * ) Notice: Subject to any disclaimer, the term of this patent is extended or adjusted under 35 U.S.C. 154(b) by 331 days.

(21) Appl. No.: 12/358,895

(22) Filed: Jan. 23, 2009

(65) Prior Publication Data

US 2010/0187323 A1 Jul. 29, 2010

(51) Int. Cl.
*A63H 18/02* (2006.01)

(52) U.S. Cl. ..... 238/10 A; 104/DIG. 1; 446/444

(58) Field of Classification Search ..... 104/53, 104/DIG. 1; 105/1.5; 238/10 R, 10 A, 10 E, 238/10 F; 446/444–447
See application file for complete search history.

(56) References Cited

U.S. PATENT DOCUMENTS

| | | | | | |
|---|---|---|---|---|---|
| 2,026,181 | A | | 12/1935 | Kennedy | |
| 2,068,403 | A | * | 1/1937 | Ekstrom | 104/140 |
| 2,153,983 | A | | 4/1939 | Kelch et al. | |
| 2,832,426 | A | | 4/1958 | Seargeant | |
| 2,895,429 | A | | 7/1959 | Baermann | |
| 3,494,070 | A | | 2/1970 | Lemelson | |
| 4,095,743 | A | * | 6/1978 | Birdsall | 238/10 F |
| 4,151,679 | A | | 5/1979 | Tanaka | |
| 4,221,076 | A | | 9/1980 | Ozawa | |
| RE30,454 | E | | 12/1980 | Birdsall | |
| 4,241,875 | A | | 12/1980 | Vandenbrink | |
| 4,397,419 | A | * | 8/1983 | Fischer | 238/10 F |
| 4,429,488 | A | | 2/1984 | Wessels | |
| 4,496,100 | A | | 1/1985 | Schwager et al. | |
| 4,504,012 | A | * | 3/1985 | Fetty et al. | 238/10 F |
| 4,540,119 | A | | 9/1985 | Neuhierl | |
| 4,799,916 | A | | 1/1989 | McKay et al. | |
| 4,941,610 | A | | 7/1990 | Frauca | |
| 5,308,274 | A | | 5/1994 | Watrobka et al. | |
| 5,579,997 | A | | 12/1996 | Jackson et al. | |
| 6,089,952 | A | | 7/2000 | Dowd et al. | |
| 6,164,555 | A | * | 12/2000 | Fulton et al. | 238/10 E |
| 6,382,519 | B1 | | 5/2002 | Choi | |
| 6,398,121 | B1 | | 6/2002 | Morgan | |
| 6,572,434 | B2 | | 6/2003 | Man | |
| 6,631,850 | B1 | | 10/2003 | Wa | |
| 7,051,948 | B2 | | 5/2006 | Wa | |
| 7,182,024 | B2 | * | 2/2007 | Pfeiffer | 104/119 |
| 2007/0037478 | A1 | * | 2/2007 | Zane | 446/444 |

* cited by examiner

*Primary Examiner* — Joe Morano, IV
*Assistant Examiner* — Zachary Kuhfuss
(74) *Attorney, Agent, or Firm* — DLA Piper LLP (US)

(57) ABSTRACT

A flexible track system includes at least one track section that includes a main body comprising two opposed side portions and a running surface extending between the two opposed side portions. The two opposed side portions extend at an angle from the running surface. Grooves are formed within the main body to allow flexion of the main body. One or more sets of a plurality of members are formed on, protrude from, and extend in a lengthwise direction along the main body. A constraining section engages a corresponding set of the members. End stops may secure the constraining sections to the main body of the track section. Force is applied to the track section to achieve a desired form or position. The grooves expand or contract in accordance with the applied force, and the constraining sections conform to and retain the applied position even after removal of the force.

22 Claims, 6 Drawing Sheets

FLEXIBLE TRACK SYSTEM

TECHNICAL FIELD

This disclosure relates generally to a flexible track system.

BACKGROUND

Tracks are widely used with trains, cars, and other toy vehicles. Some tracks may require assembly of various pieces to form the track, while other tracks may be a single formed structure. The tracks formed of various pieces may provide flexibility but may not have a smooth surface for the movement of trains and other vehicles. Moreover, tracks formed of various pieces require assembly of the pieces, which leads to expense for the manufacturer and/or inconvenience for the customer. Other tracks may not be flexible, portable, and/or adaptable.

A track system is desired that allows for the smooth movement of vehicles, such as trains, cars, and the like, over continuous portions of the track. It is further desired that the track system be flexible to change direction and shape and that the track system stand on its own or be incorporated with and into other track systems.

SUMMARY

A flexible track system supports one or more vehicles for movement thereon. At least one track section is provided to form the track system. The track section includes a main body with two opposed side portions and a running surface that extends between the two opposed side portions. The two opposed side portions extend at an angle from the running surface. Multiple grooves are formed within the main body to allow flexion of the main body. One or more sets of members are formed on and protrude from the main body, and each set of members extends in a lengthwise direction along the main body. A constraining section is configured to engage a corresponding set of members to conform to and retain a position applied to the main body.

A flexible track system includes at least one track section for supporting one or more vehicles for movement thereon. Each track section includes a main body with two opposed side portions that extend at an angle from a running surface extending between the two opposed side portions. A plurality of grooves are formed within the main body of the track section to allow flexion of the main body. At least two sets of members are formed on and protrude from an underside of the running surface. Each set extends in a lengthwise direction along the underside section. A constraining section is configured to engage a corresponding set of members to conform to and retain a position applied to the main body of the track section.

DETAILED DESCRIPTION

Figure 1A:
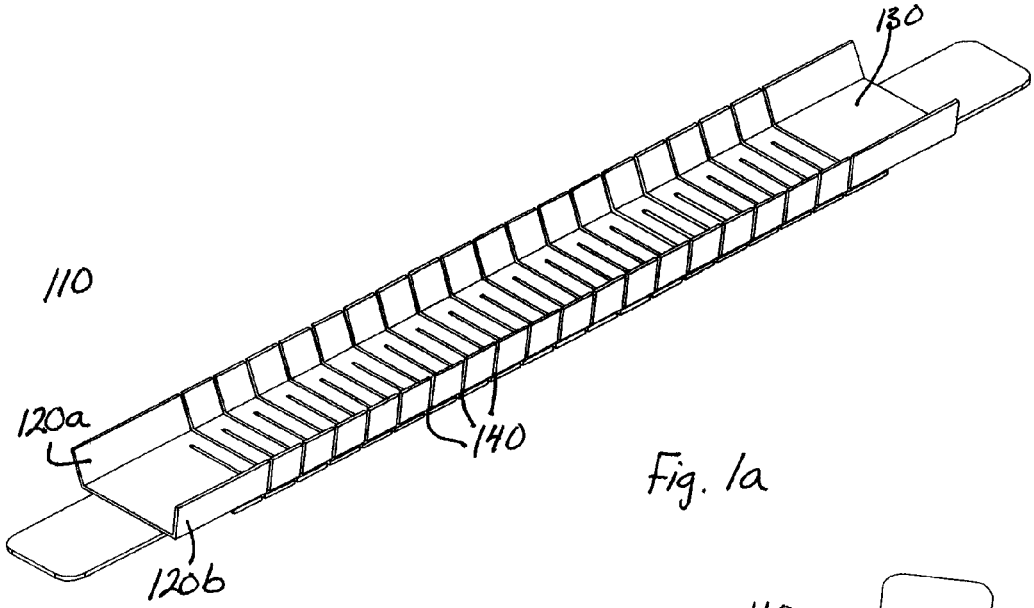
FIG. 1*a* is a perspective view of a main body of a track section.

It will be appreciated that the following description is intended to refer to specific examples of structure, selected for illustration in the drawings and is not intended to define or limit the disclosure, other than in the appended claims.

A flexible track system may include at least one track section to support one or more vehicles, such as toy trains, cars, and the like, for movement thereon. The track section may stand on its own as the complete track system. Alternatively, the track section may be connected to or incorporated with other similar sections or other tracks to extend a track system.

Figure 1C:
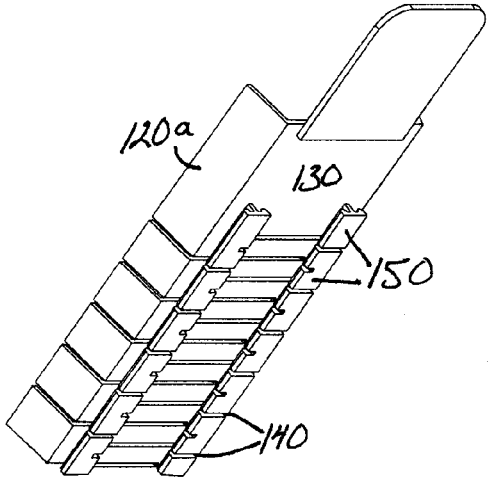
FIG. 1*c* is a perspective view of the main body of FIG. 1*a* with a set of protruding members.
Figure 1B:
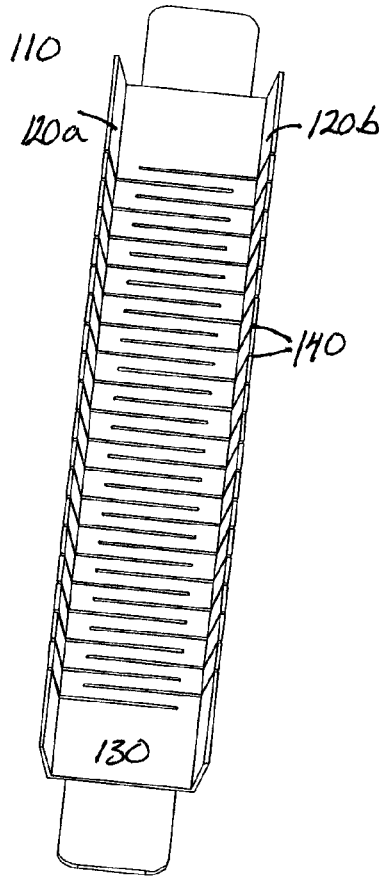
FIG. 1*b* is a second perspective view of the main body of FIG. 1*a*.

FIG. 1*a* and FIG. 1*b* provide perspective views of a main body 110 of a track section 100. The main body 110 includes two opposed side portions 120*a* and 120*b* and a running surface 130 that extends between the two opposed side portions 120*a* and 120*b*. The two opposed side portions 120*a* and 120*b* extend at an angle from the running surface 130 and thus form a type of edge or barrier for the running, surface 130, upon which one or more vehicles may be moved. The two opposed side portions 120*a* and 120*b* may extend at different angles from the running surface 130. The angles at which the two opposed side portions 120*a* and 120*b* extend may be at or near about 90 degrees, although other angles are also suitable.

As illustrated in FIGS. 1*a* and 1*b*, a plurality of grooves 140 are formed within the main body 110. The grooves 140 are expandable and contractible to allow for flexion of the main body 110. Each or some of the grooves 140 may be substantially perpendicular to a lengthwise direction of the main body 110. Each groove 140 may extend along one of the two opposed sides 120*a* and 120*b* and at least a portion of the running surface 130. Moreover, a pattern of grooves 140 may be established in which the grooves 140 alternate between being formed on one of the two opposed sides 120*a* and 120*b* and a portion of the running surface 130, then on the other of the two opposed sides 120*a* and 120*b* and a portion of the running surface 130. For example, a first groove 140 may be formed on side 120*a* and a portion of the running surface 130, while a second groove 140 may be formed on side 120*b* and a portion of the running surface 130. The grooves 140 are not limited, to such a pattern, and other patterns may be employed.

The track section 100 further includes at least one set of a plurality of members 150 that are formed on, or otherwise attached to, and protrude from the main body 110 of the track section 100. FIG. 1*c* is a perspective view of the track section 100, illustrating two sets of a plurality of members 150. Each set of the plurality of members 150 extends in a lengthwise direction along the main body 110.

The two sets, of the plurality of members 150 shown in FIG. 1*c* extend along an underside of the running surface 130, near the lengthwise edges of the running surface 130. However, the one or more sets of the plurality of members 150 are not limited to such an arrangement. For example, one, set of the plurality of members 150 may be formed on, protrude from, and extend in a lengthwise direction along a middle portion of the underside or a topside of the running surface 130. In another structure, two sets of the plurality of members 150 may be formed on, protrude from, and extend in a lengthwise direction near the edges and along the topside of the running surface 130. In yet another structure, one set of the plurality of members 150 may be formed on, protrude from, and extend in a lengthwise direction along one of the two opposed sides 120*a* and 120*b*. Or one set may be formed on one of the two opposed sides 120*a* and 120*b*, while another set is formed on the other of the two opposed sides 120*a* and 120*b*.

Figure 2A:
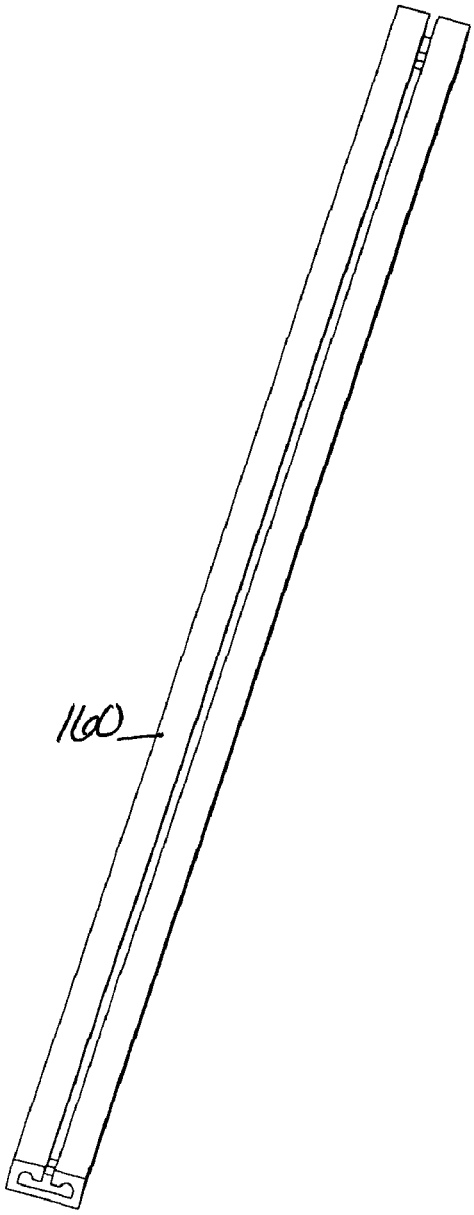
FIG. 2*a* is a perspective view of a constraining section of a track section.

FIG. 2*a* is a perspective view of a constraining section 160 of the track section 100. The constraining section 160 is configured to engage a corresponding set of the plurality of members 150. The constraining section 160 may be made from a flexible material, such as, for example, polyvinyl chloride (PVC) or the like. The constraining section 160 conforms to and retains a position applied to the main body 110.

Figure 2B:
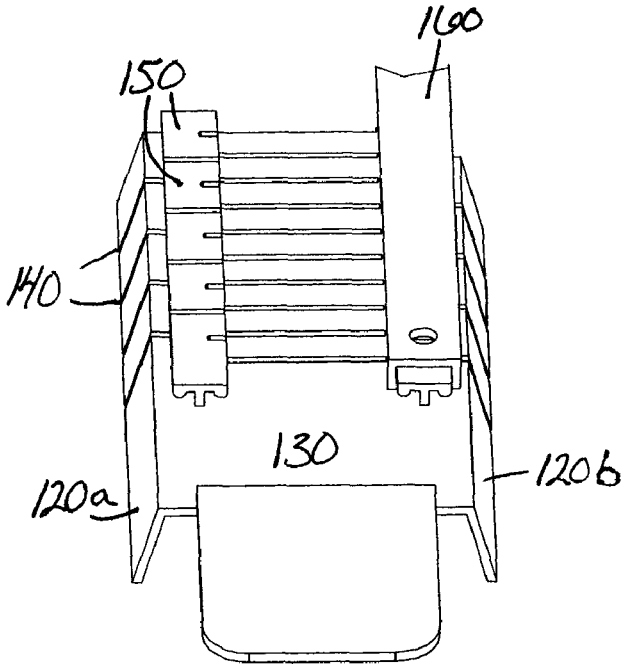
FIG. 2*b* is a perspective view of the constraining section of FIG. 2*a* connected to the main body of FIG. 1*a*.

FIG. 2*b* provides a perspective view of the constraining section 160 connected to the main body 110. As shown in FIG. 2*b*, one constraining section 160 is engaged with a corresponding set of a plurality of members 150. The track section 100 may include a constraining section 160 for engagement with each set of the plurality of members 150.

In one form, each of the plurality of members 150 is substantially in the form of a T-shape, and the one or more constraining sections 160 comprises an inverse substantially T-shaped section for engaging the T-shaped members 150. In this form, the constraining section 160 may slide over the plurality of the T-shaped members 150 to engage a corresponding set of members 150. The sets of the plurality of members 150 and their corresponding constraining sections 160 are not limited to the T-shaped and inverse T-shaped forms, and other shapes and forms may be employed. Also, other forms of engagement between members 150 and constraining sections 160 may be used. For example, such engagement can be a form and shape of a constraining section 160 that "snaps" on to members 150. Other examples could include adhesives, separate connector pieces, and the like.

The track section 100 may further include one or more end stops 170. Each end stop 170 may removably secure a constraining section 160 to the main body 110 of the track section 100. Each end stop 170 is formed on, or otherwise attached to, and protrudes from the main body 110. In one form, an end stop 170 for a corresponding constraining section 160 is formed on and protrudes from the same section of the main body 110 as that of the set of the plurality of members 150 to which the constraining section 160 is engaged. For example, if a constraining section 160 is engaged with a set of a plurality of members 150 on the underside of the running surface 130, the corresponding end stop 170 may also be formed on and protrudes from the underside of the running surface 130. Additionally, the one or more end stops 170 may be the first and/or last members of the set of the plurality of members 150 to secure an end of the constraining section 160 to the main body 110. The one or more end stops 170 may also be of the same shape and form as the plurality of members 150. Additionally, the end stop 170 may include a screw and may secure the constraining section 160 through a corresponding opening formed within the constraining section 160.

Figure 3A:
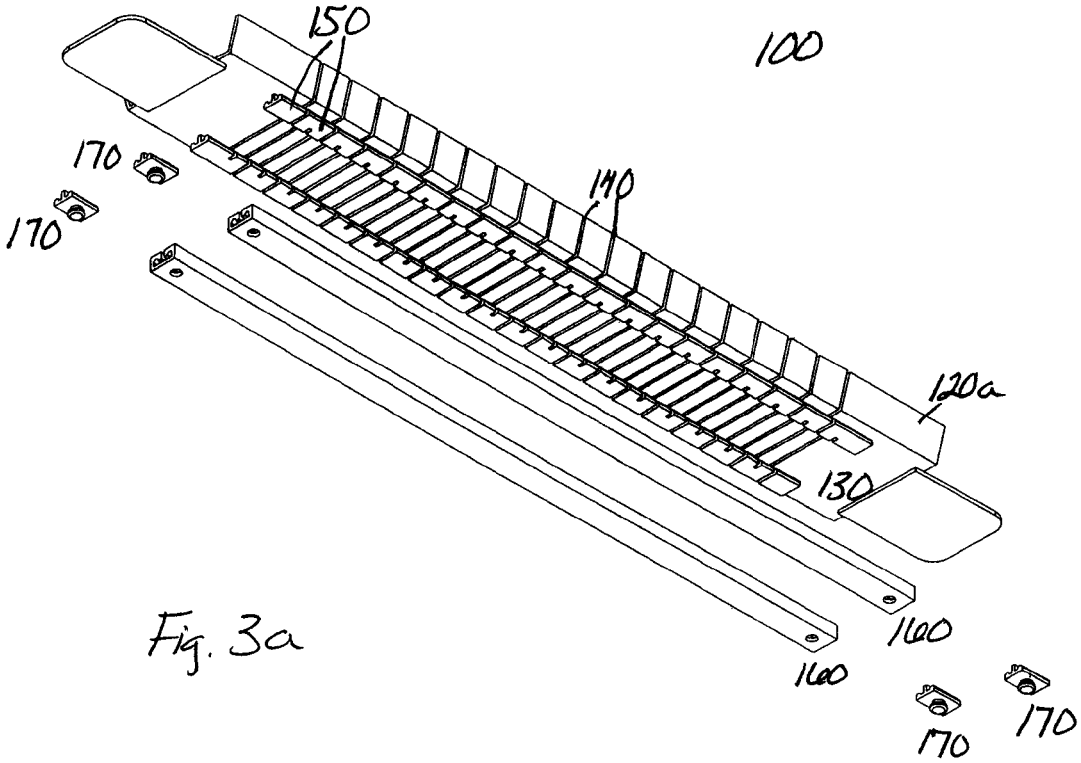
FIG. 3*a* is a perspective view of various components of a track section.
Figure 3B:
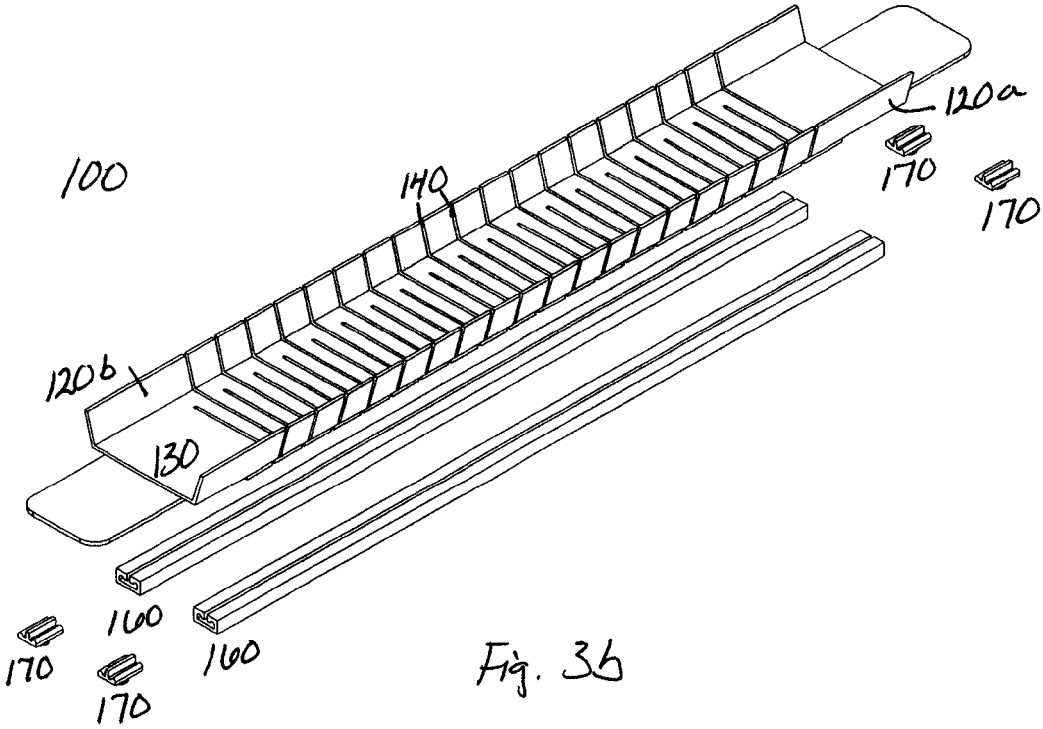
FIG. 3*b* is a second perspective view of the components of FIG. 3*a*.
Figure 3C:
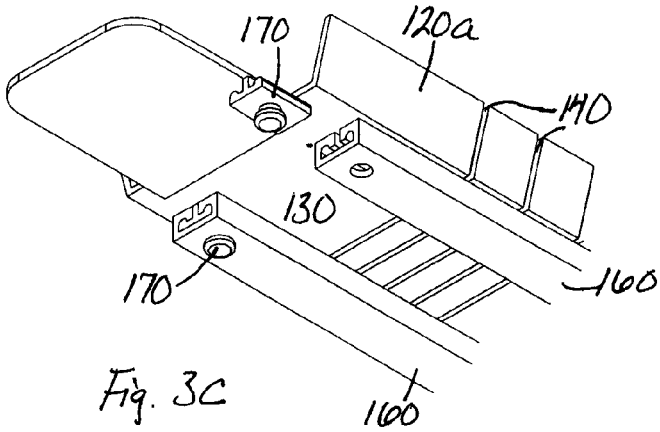
FIG. 3*c* is a third perspective view of the components of FIG. 3*a*.

With reference to FIGS. 3*a* and 3*b*, two perspective views of components of the track section 100 are shown. The perspective views illustrate the components of the track section 100 prior to connection. As shown, two sets of a plurality of members 150 are formed near edges of an underside of the running surface 130. The train track section 100 includes two corresponding constraining sections 160 to engage the two sets of the plurality of members 150, respectively. Also included in the structure of FIGS. 3*a* and 3*b* are two end stops 170 (disconnected from the main body 110) for each constraining section 160. Each end stop 170 includes a screw for securing the constraining sections 160 to the main body 110, while the constraining sections 160 include a corresponding opening. In this form, the end stops 170 secure both ends of each of the constraining sections 160. FIG. 3*c* provides an additional, close-up perspective view of end stops 170 and the constraining sections 160.

Figure 4A:
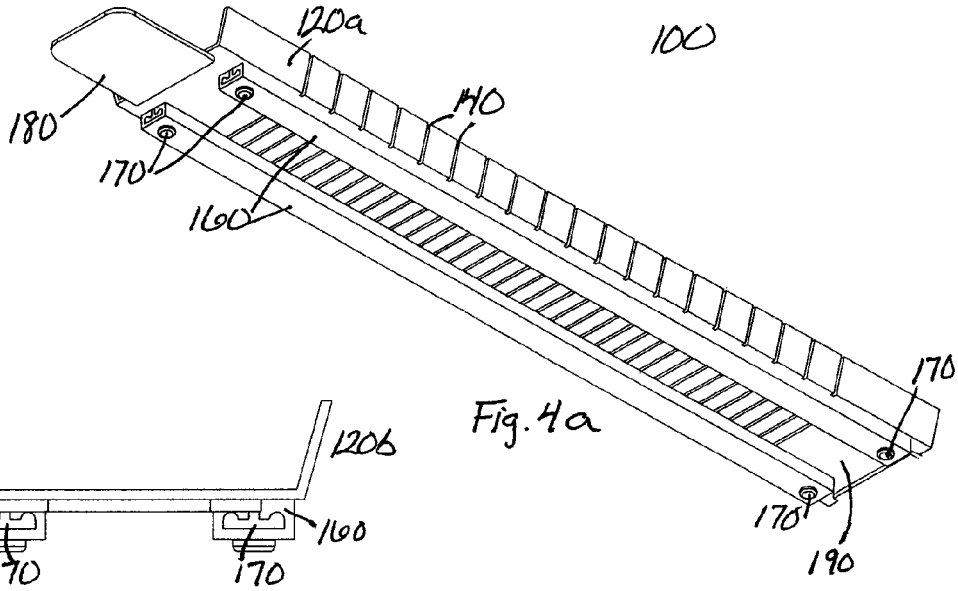
FIG. 4*a* is a perspective view of a track section.
Figure 4C:
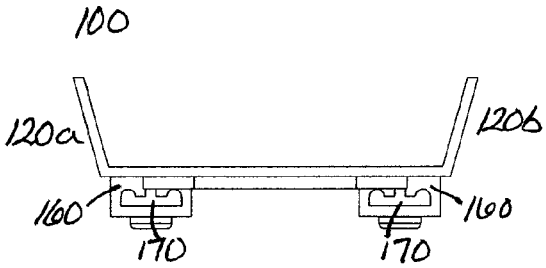
FIG. 4*c* is a schematic front view of the track section of FIG. 4*a*.
Figure 4B:
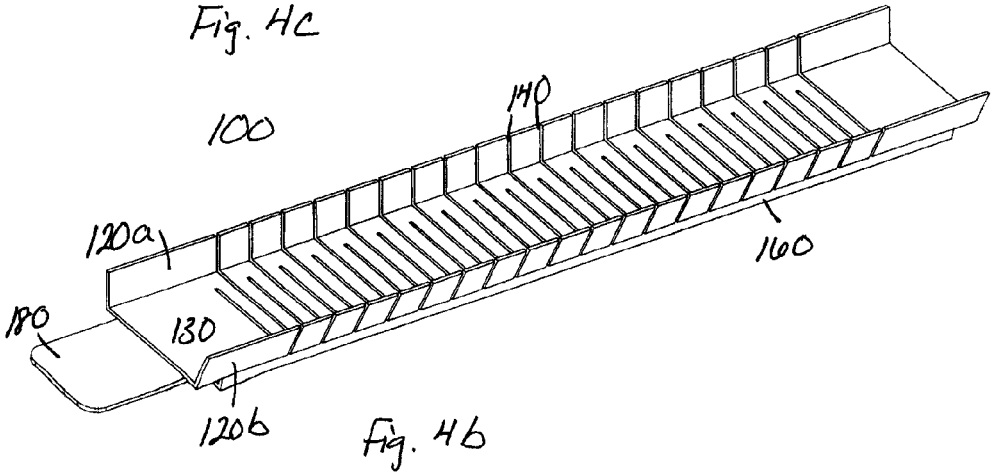
FIG. 4*b* is a second perspective view of the track section of FIG. 4*a*.
Figure 5A:
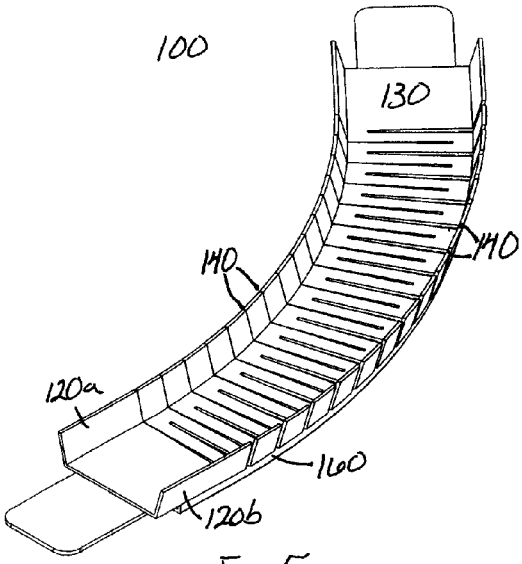
FIG. 5*a* is a perspective view of a curved track section.
Figure 5B:
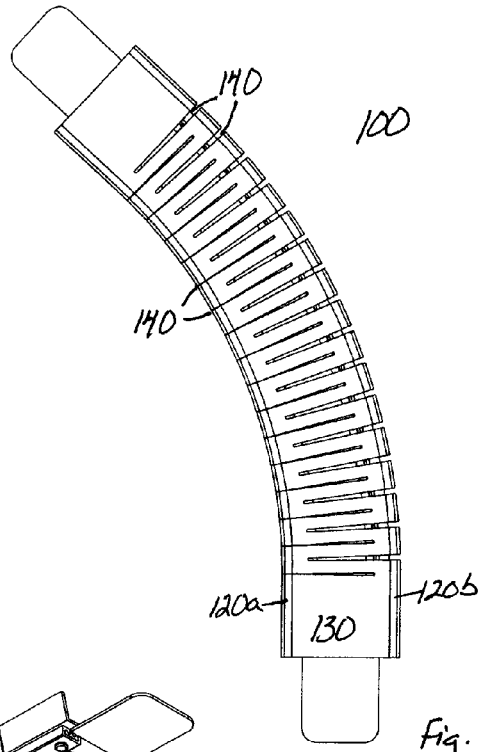
FIG. 5*b* is a second perspective view of the curved track section of FIG. 5*a*.
Figure 5C:
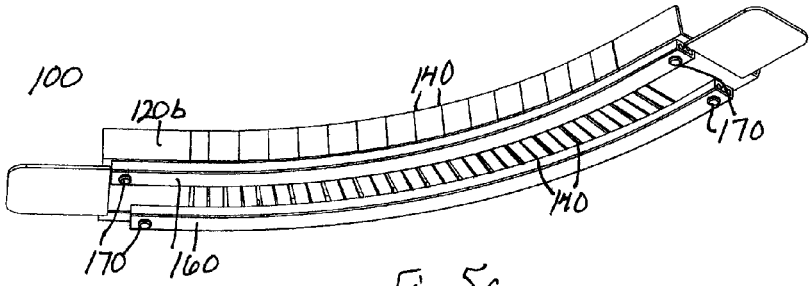
FIG. 5*c* is a third perspective view of the curved track section of FIG. 5*a*.
Figure 5D:
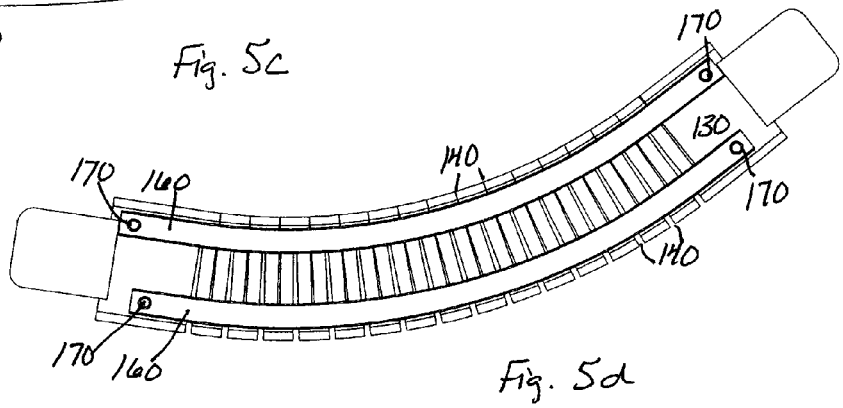
FIG. 5*d* is a fourth perspective view of the curved track section of FIG. 5*a*.

FIGS. 4*a* and 4*b* are perspective views of an assembled track section 100. FIG. 4*c* is a schematic front view of the assembled track section 100. The track section 100 includes two opposed side portions 120*a* and 120*b* that extend at an angle from the running surface 130. The track section 100 further includes two sets of a plurality of T-shaped members 150, each with a corresponding constraining section 160 that comprises an inverse T-shaped section to engage the T-shaped members 150. The sets of the plurality of members 150 are formed on and protrude from an underside of the running surface 130. End stops 170 for each constraining section 160 include screws for securing the constraining, sections 160 to the main body 110.

FIGS. 5*a*-5*d* are perspective views of a curved track section 100. The track section 100 may take various forms, including but not limed to the curved shape illustrated in FIGS. 5*a*-5*d*. Thus, track sections 100 can be horizontally curved and/or somewhat vertically curved and/or can have selected portions curved in opposed horizontal and/or vertical directions.

When force is applied to the track section 100 to achieve a desired form or position of the main body 110, the grooves 140 expand or contract in accordance with the applied force. Thus, for example, if a track section 100 is horizontally curved as shown in FIGS. 5*a*-5*d*, the expansion of the grooves 140 on an outward section of the track section 100 cause the outward section to extend, while the contraction of the grooves 140 on an inner section of the track section 100 cause the inner section to compress. In another form, when the track section 100 is curved vertically upward, the grooves 140 expand and the track section 100 accordingly extends. When, in yet another form, the track section 100 is curved vertically downward, the grooves 140 contract and the track section accordingly compresses. When force is applied to the track section 100, the constraining sections 160 accordingly move and/or slide along the members 150 and conform to the applied position to accommodate the expansion or contraction of the grooves 140. The end stops 170 may serve to prevent the constraining sections 160 from moving and/or sliding beyond the end stops 170. Moreover, the constraining sections 160 retain the applied position even after the applied force is removed due to friction between the constraining sections 160 and the main body 110. The constraining sections 160 also prevent excessive movement, such as bending the main body 110 so that, for example, one end touches the other end of the main body 110.

Figure 6:
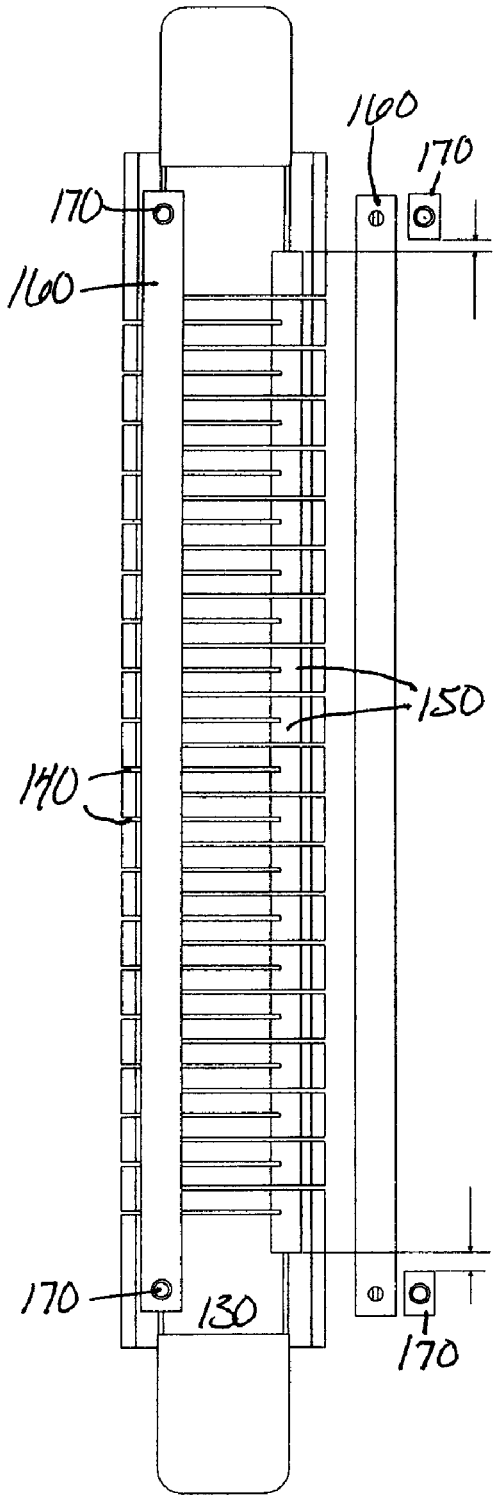
FIG. 6 is a perspective view of a track section.

FIG. 6 is a perspective view of an underside of a track section 100. As mentioned above, the end stops 170 may be the first and/or last members of the set of the plurality of members 150. In the illustrated structure, the end stops 170 are both the first and last members 150 of each set. It is also possible that each end stop 170 is spaced apart from the corresponding set of the plurality of members 150 to allow the members 150 to move within the constraining section 160.

The track section 100 may serve as an entire track system in itself. Alternatively, the track section 100 may connect to pre-set track sections or other track sections 100 to expand a track system. Moreover, each track section 100 may fit within and/or over other objects. In particular, and with reference to FIGS. 4*a*-4*b*, a track section 100 may include one or more tongues 180 that extend from an end of the track section 100 to connect the track section 100 to other track sections 100 or to other tracks. The track section 100 may include an opening 190 formed on an underside of the running surface 130 to engage the tongue 180 of another track section 100 or other track. In one form, the track section 100 may not include any tongues 180 and may instead connect to other track sections 100 or other tracks by a separate connection piece (not shown). In another form, the track section 100 may include clamps to secure the tongue 180 and the track section 100 to the underside of the main body 110. The track section 100 is not limited to any particular type of connection means.

While in the foregoing detailed description of this disclosure has been described in relation to certain representative structures thereof, and many details have been set forth for purposes of illustration, it will be apparent to those skilled in the art that the disclosure can be varied considerably without departing from the basic principles of the disclosure.

The invention claimed is:

1. A flexible track system that supports one or more vehicles for movement thereon, the track system comprising:

at least one track section, each track section comprising:

a main body comprising two opposed side portions and a running surface upon which the one or more vehicles move that extends between the two opposed side portions, wherein the two opposed side portions extend at an angle from the running surface, wherein a plurality of grooves are formed within the main body to allow flexion of the main body;

at least one set of a plurality of members formed on and protruding from the main body and extending in a lengthwise direction along the main body;

at least one constraining section configured to engage a corresponding set of the plurality of members to conform to and retain a position applied to the main body; and at least one end stop formed on and protruding from the main body, wherein each of the at least one end stops secures to the main body one of the at least one constraining sections and each of the at least one end stops comprises a screw formed within a substantially T-shaped member, wherein each of the plurality of at least one constraining sections comprises an opening for connection with a corresponding end stop via the screw.

2. The track system of claim 1, wherein each of the at least one set of a plurality of members are formed on, protrude from, and extend in a lengthwise direction along one of (i) an underside of the running surface; (ii) a topside of the running surface; and (iii) a side of one of the two opposed side portions.

3. The track system of claim 1, wherein each of the at least one end stops is spaced apart from the at least one set of the plurality of members.

4. The track system of claim 1, wherein each of the plurality of grooves extends along one of the two opposed side portions and at least a portion of the running surface.

5. The track system of claim 1, wherein the plurality of grooves form a pattern comprising alternating between (i) a groove extending from one of the two side portions to at least a portion of the running surface and (ii) a groove extending from the other of the two side portions to at least a portion of the running surface.

6. The track system of claim 1, wherein each of the plurality of grooves is substantially perpendicular to a lengthwise direction of the main body.

7. The track system of claim 1, wherein each of the plurality of grooves expand and contract to allow for the flexion of the main body.

8. A flexible track system that supports one or more vehicles for movement thereon, the track system comprising:

at least one track section, each track section comprising:

a main body comprising two opposed side portions and a running surface upon which the one or more vehicles move that extends between the two opposed side portions, wherein the two opposed side portions extend at an angle from the running surface, wherein a plurality of grooves are formed within the main body to allow flexion of the main body;

at least one set of a plurality of members formed on and protruding from the main body and extending in a lengthwise direction along the main body; and at least one constraining section configured to engage a corresponding set of the plurality of members to conform to and retain a position applied to the main body, wherein at least one set of plurality of members comprises a set of a plurality of substantially T-shaped members, wherein the at least one constraining section comprises an inverse substantially T-shaped section to engage a corresponding set of the plurality of the T-shaped members.

9. The track system of claim 1, wherein each of the at least one track sections connects to pre-set track sections.

10. The track system of claim 1, wherein each of the at least one track sections connects to other of the track sections.

11. The track system of claim 1, wherein each of the at least one track sections flexibly fits within and/or over one or more objects.

12. A flexible track system that supports one or more vehicles for movement thereon, the track system comprising:

at least one track section, each track section comprising:

a main body comprising two opposed side portions and a running surface upon which the one or more vehicles move that extends between the two opposed side portions, wherein the two opposed side portions extend at an angle from the running surface, wherein a plurality of grooves are formed within the main body to allow flexion of the main body;

at least two sets of a plurality of members formed on and protruding from an underside of the running surface and extending in a lengthwise direction along the underside of the running surface; and at least two constraining sections, each configured to engage a corresponding set of the plurality of members to conform to and retain a position applied to the main body.

13. The track system of claim 12, wherein a first set of a plurality of members is formed near a first lengthwise edge of the underside of the running surface, and wherein a second set of a plurality of members is formed near a second lengthwise edge of the underside of the running surface.

14. The track system of claim 12, further comprising at least one end stop formed on and protruding from the underside of the running surface, wherein each end stop secures to the underside of the running surface one constraining section.

15. The track system of claim 14, wherein each constraining section is secured by two end stops, wherein the two end stops for each constraining section are formed as the first and last members of a set of the plurality of members corresponding to the constraining section.

16. The track system of claim 15, wherein the two end stops for each constraining section are spaced apart from the plurality of members.

17. The track system of claim 12, wherein each of the plurality of grooves extends along one of the two opposed side portions and at least a portion of the running surface, and wherein each of the plurality of grooves is substantially perpendicular to a lengthwise direction of the main body.

18. The track system of claim 12, wherein each of the plurality of grooves expand and contract to allow for the flexion of the main body.

19. The track system of claim 12, wherein at least one set of a plurality of members comprises a set of a plurality of substantially T-shaped members, wherein a corresponding constraining section comprises an inverse substantially T-shaped section to engage the corresponding set of the plurality of the T-shaped members.

20. The track system of claim 12, wherein each track section further comprises a tongue extending from one end of the track section and an opening formed on an underside of the running surface on the other end of the track section to engage a tongue of another track section.

21. The track system of claim 12, wherein each track section further comprises a tongue extending from at least one end of the track section for connecting to a track.

22. The track system of claim 8, wherein the at least one constraining section slides over the corresponding set of the plurality of the T-shaped members.

* * * * *